US008769110B2

(12) United States Patent
Amendolagine et al.

(10) Patent No.: US 8,769,110 B2
(45) Date of Patent: Jul. 1, 2014

(54) TRANSFERRING RUI FROM ONE DEVICE TO ANOTHER

(75) Inventors: James Amendolagine, San Marcos, CA (US); Jason Clement, San Diego, CA (US)

(73) Assignee: Sony Corporation, Tokyo (JP)

( * ) Notice: Subject to any disclaimer, the term of this patent is extended or adjusted under 35 U.S.C. 154(b) by 466 days.

(21) Appl. No.: 13/118,091

(22) Filed: May 27, 2011

(65) Prior Publication Data

US 2012/0299811 A1 Nov. 29, 2012

(51) Int. Cl.
*G09G 5/00* (2006.01)

(52) U.S. Cl.
USPC ..... 709/227; 715/740; 345/156

(58) Field of Classification Search
USPC ..... 709/227; 715/740; 345/156
See application file for complete search history.

(56) References Cited

U.S. PATENT DOCUMENTS

| | | | | |
|---|---|---|---|---|
| 5,831,609 | A * | 11/1998 | London et al. | 715/746 |
| 7,020,882 | B1 | 3/2006 | Lewallen | |
| 7,844,661 | B2 * | 11/2010 | Fang et al. | 709/203 |
| 7,970,966 | B1 * | 6/2011 | Hobbs | 710/72 |
| 8,595,371 | B2 * | 11/2013 | Messer | 709/230 |
| 8,640,031 | B2 * | 1/2014 | Kim et al. | 715/734 |
| 2003/0169293 | A1 * | 9/2003 | Savage | 345/762 |
| 2005/0022210 | A1 * | 1/2005 | Zintel et al. | 719/318 |
| 2006/0159109 | A1 * | 7/2006 | Lamkin et al. | 370/401 |
| 2006/0161635 | A1 * | 7/2006 | Lamkin et al. | 709/217 |
| 2006/0168526 | A1 * | 7/2006 | Stirbu | 715/740 |
| 2006/0179118 | A1 * | 8/2006 | Stirbu | 709/217 |
| 2006/0200570 | A1 * | 9/2006 | Stirbu et al. | 709/230 |
| 2006/0227768 | A1 * | 10/2006 | Sauber et al. | 370/360 |
| 2006/0293769 | A1 * | 12/2006 | Rosenbloom et al. | 700/88 |
| 2007/0061748 | A1 * | 3/2007 | Hirose | 715/764 |
| 2007/0089055 | A1 * | 4/2007 | Ko et al. | 715/700 |
| 2007/0174301 | A1 * | 7/2007 | Kim et al. | 707/10 |
| 2007/0192441 | A1 * | 8/2007 | Jin et al. | 709/219 |
| 2007/0203979 | A1 * | 8/2007 | Walker et al. | 709/204 |
| 2008/0034029 | A1 * | 2/2008 | Fang et al. | 709/203 |
| 2008/0040351 | A1 * | 2/2008 | Jin et al. | 707/9 |
| 2008/0052347 | A1 * | 2/2008 | Jung et al. | 709/203 |
| 2008/0157936 | A1 * | 7/2008 | Ebrom et al. | 340/286.02 |
| 2008/0201306 | A1 * | 8/2008 | Cooper et al. | 707/3 |
| 2008/0243998 | A1 | 10/2008 | Oh et al. | |
| 2009/0062947 | A1 * | 3/2009 | Lydon et al. | 700/94 |
| 2009/0210488 | A1 * | 8/2009 | Lee | 709/203 |
| 2010/0115053 | A1 * | 5/2010 | Ryu et al. | 709/217 |
| 2010/0235739 | A1 * | 9/2010 | Rathi et al. | 715/716 |
| 2010/0306312 | A1 * | 12/2010 | Ryu et al. | 709/203 |
| 2011/0047474 | A1 * | 2/2011 | Sung et al. | 715/740 |
| 2011/0050449 | A1 * | 3/2011 | Park et al. | 340/825.22 |

(Continued)

OTHER PUBLICATIONS

Richard Verhoeven et al., "Defining Services for Mobile Terminals using Remote User Interfaces".

(Continued)

*Primary Examiner* — Alina N. Boutah
(74) *Attorney, Agent, or Firm* — Haverstock & Owens LLP

(57) ABSTRACT

A method of and system for transferring a remote user interface from one device to another device is described herein. A server stores state information and uses the information to transfer the RUI and/or other data from one device to the other device. This enables a user to transition from one device to another device seamlessly and without interruption of their user interface and/or programming.

26 Claims, 3 Drawing Sheets

(56) References Cited

U.S. PATENT DOCUMENTS

| | | | | |
|---|---|---|---|---|
| 2011/0055716 | A1* | 3/2011 | Kim et al. | 715/740 |
| 2011/0060841 | A1* | 3/2011 | Bang et al. | 709/231 |
| 2011/0060999 | A1* | 3/2011 | So et al. | 715/740 |
| 2011/0066679 | A1* | 3/2011 | Irvine et al. | 709/203 |
| 2011/0072081 | A1* | 3/2011 | Fang et al. | 709/203 |
| 2011/0072359 | A1* | 3/2011 | So et al. | 715/744 |
| 2011/0131505 | A1* | 6/2011 | Park et al. | 715/745 |
| 2011/0154205 | A1* | 6/2011 | Kim et al. | 715/733 |
| 2012/0099594 | A1* | 4/2012 | Lau et al. | 370/392 |
| 2012/0110448 | A1* | 5/2012 | Jhoney et al. | 715/704 |
| 2012/0159344 | A1* | 6/2012 | Park et al. | 715/740 |
| 2012/0192230 | A1* | 7/2012 | Algie et al. | 725/38 |
| 2012/0226992 | A1* | 9/2012 | Clift et al. | 715/740 |
| 2012/0233286 | A1* | 9/2012 | Chee et al. | 709/217 |
| 2012/0233552 | A1* | 9/2012 | Chee et al. | 715/745 |
| 2012/0254446 | A1* | 10/2012 | Lejeune et al. | 709/227 |
| 2012/0254453 | A1* | 10/2012 | Lejeune et al. | 709/230 |
| 2012/0254766 | A1* | 10/2012 | Lejeune et al. | 715/740 |

OTHER PUBLICATIONS

Mario Bisignano et al., "An "Intent-Oriented" Approach for Multi-Device User Interface Design", Apr. 18-Apr. 20, Vienna, Austria, http://www2.computer.org/ortal/web/csdl/doi/10.1109/AINA.2006.77.

* cited by examiner

TRANSFERRING RUI FROM ONE DEVICE TO ANOTHER

FIELD OF THE INVENTION

The present invention relates to the field of remote user interfaces. More specifically, the present invention relates to transferring a remote user interface from a device to another device.

BACKGROUND OF THE INVENTION

The number of electronic devices in people's homes is continually increasing. Many years ago, homes only had a radio; then, a radio and a television. The number of devices has increased to the point where a typical home has several televisions, stereos, computers, video game consoles, mobile phones/devices, appliances and others. Furthermore, these devices are gaining intelligence so that they are able to communicate with each other.

The expansion of residential networks to include a multiplicity of devices that can share files asynchronously and connect to the Internet through residential gateways was facilitated by the de-facto standard use of wired and wireless ethernet connectivity. Asynchronous sharing then started to give way to buffered streaming of video as bandwidth availability improved. This was closely followed by real time streaming. Networks employ quality of service to manage bandwidth resources and Universal Plug and Play (UPnP) to perform discovery and compatibility of compressed video content. Video UPnP also defines remote user input operation like play, stop and rewind so that video control as well as video display is able to be performed remotely. Also, provisions were made to support graphical transfer of a remote user interface, but no implementations on the market have made use of this. UPnP allowed for many different standards of compressed video but does not, however, certify that a client supported the relevant decoder. Digital Living Network Alliance (DLNA) is a standards body formed to provide certified device compatibility for a specific subset of UPnP implementations. DLNA also defined the role of media servers, renderers, adapters, players and controllers.

A standard, referred to as Remote User Interface (RUI or Remote UI) is being developed to allow devices to operate each other and provide the user with a user interface that is configured appropriately for a device being used to control another device. For example, a user interface for a 46" wide television is not likely to appear properly on a mobile phone which has a display of 2". The Remote UI standard is a web-based protocol and framework for remote user interface on UPnP Networks and the Internet. The standard allows a UPnP-capable home network device to provide its interface (display and control options) as a web page to display on any other device coupled to the home network.

There are no well defined and widely accepted UPnP implementations for graphical RUI. One option, which has been backed by the UPnP Forum, is a browser based implementation known as CEA2014. The network client browser is considered to be heavy in flash, memory and/or processor requirements ('thick' client), whereas the network server application performs simple encapsulation of XML ('thin' server). In some situations this may be acceptable, like the case when rendering is performed by a personal computer and the application is run on a small mobile device, or a low end processing device, like a network router.

However, in the case of the home network where the rendering is done by a high definition TV, a Blu-Ray® player, a picture frame or a gaming machine, the use of a browser for RUI has some disadvantages. Firstly, a browser adds to the already substantial memory requirements of the renderers and so for these cost sensitive consumer electronics devices it may not be viable. Secondly, the processing speed requirements for a responsive experience are not going to be provided by the current range of devices available. And thirdly, the browser interface lends itself well to mouse and keyboard control, but is not necessarily the ideal format for a limited button remote control.

Also, the home network is able to include graphics applications built into game machines, video players, dongles and intelligent remotes on the low end, with cable boxes, cloud servers and multimedia PCs on the high end. To shoehorn all of these into one UPnP standard, it is clear that reach will be limited. In some cases substantial effort of rewriting or translation of the graphics application might be needed in order to fit the browser framework.

Another example of a proposed RUI is being provided through the RVU alliance. The RVU alliance was initiated by DirectTV in order to provide a pixel accurate remotely rendered version of their satellite decoder user interface. Unlike the browser based RUI, RVU uses a low level protocol that manipulates the graphics card framebuffer layers more directly. Instead of the script type messages that CEA2014 uses, RVU breaks up elements of the graphics into images that can be sent compressed or uncompressed over the network to be composited in the renderers screen buffers or off screen buffers as needed. Simple bit commands are sent over the network to allow the images to be stretched, cut and alpha-blended on the renderer side. This type of RUI would be considered a thin network client and thick network server because most of the computation effort would be with the application. Also, because most actions involve sending image data, this type of RUI uses a lot of network resources.

The advantage of RVU is that the low level graphics operations are able to be supported by all graphics cards quite easily and is not directly dependent on the type of application to be able to function. However, sometimes performance is a key parameter in usability, and as such the network load and network server performance could severely limit how useful the protocol is. RVU is especially vulnerable where complete screen refreshes are needed often, like 3D rotations of a view. A browser approach could handle this more simply through scripts of simple rotation commands. Another similar limitation is when the application is providing remote graphics to multiple renderers, and causes the application processor to run short of the necessary MIPS to perform adequately.

SUMMARY OF THE INVENTION

A method of and system for transferring a remote user interface from one device to another device is described herein. A server stores state information and uses the information to transfer the RUI and/or other data from one device to the other device. This enables a user to transition from one device to another device seamlessly and without interruption of their user interface and/or programming.

In one aspect, a method of transferring a remote user interface from a first device to a second device comprises determining a remote user interface state information, storing the remote user interface state information and transferring the remote user interface to the second device including the remote user interface state information. The method further comprises halting the remote user interface on the first device. The method further comprises displaying the remote user interface on the second device. Transferring includes transferring media from the first device to the second device. The remote user interface is transferred but a media remains on the first device. The media is at least one of an audio and a video. The remote user interface state information is stored on a server device. The server device, the first device and the second device are selected from the group consisting of a personal computer, a laptop computer, a computer workstation, a server, a mainframe computer, a handheld computer, a personal digital assistant, a cellular/mobile telephone, a smart appliance, a gaming console, a digital camera, a digital camcorder, a camera phone, an iPhone, an iPod®, a video player, a DVD writer/player, a television, a home entertainment system and an intelligent appliance.

In another aspect, a network of devices comprises a first user device for displaying a remote user interface, a second user device for displaying the remote user interface and a server device for transferring the remote user interface from the first user device to the second user device. The server device stores a state of the remote user interface. The remote user interface is halted on the first device. Transferring includes transferring media from the first device to the second device. The remote user interface is transferred but a media remains on the first device. The media is at least one of an audio and a video.

In another aspect, a system programmed in a controller in a device comprises a state monitoring module for monitoring a state of a remote user interface on a first device and a transferring module for transferring the remote user interface to a second device. The system further comprises a halting module for halting the remote user interface on the first device. The transferring module is for transferring media to the second device. The transferring module is for transferring the remote user interface but a media remains on the first device. The media is at least one of an audio and a video. The system further comprises a storage module for storing the remote user interface state information.

In another aspect, a server device comprises a memory for storing an application, the application for determining a remote user interface state information of a remote user interface, storing the remote user interface state information and transferring the remote user interface to a receiving device including the remote user interface state information and a processing component coupled to the memory, the processing component for processing the application. The application is further for halting the remote user interface on a first device. Transferring includes transferring media from a first device to the receiving device. The remote user interface is transferred but a media remains on a first device. The media is at least one of an audio and a video. The remote user interface state information is stored in the memory.

DETAILED DESCRIPTION OF THE PREFERRED EMBODIMENT

A method of and system for transferring a Remote User Interface (RUI) from one device to another device using a persistent application state utilizing a remote graphics rendering that is able to hold a persistent application state and is able to gracefully lose connectivity with a rendering node are described herein. The method and system are able to migrate the rendering state to another node. The method and system are also able to migrate the render side and hold it so that the user interface is able to migrate from one device to another device.

The method and system are also for distributing a device user interface and user input across multiple devices by separating the application presentation into discrete presentation components that are rendered and/or executed on remote devices.

Control and management of a device through a user interface that is able to be rendered locally or remotely in whole or in part without the need to generate separate applications for each remote device is also described. This has been addressed to some degree in the past with web browsers, client server architectures and distributed applications. Transferring an RUI to another device loosely resembles a distributed application model but eliminates the need to address each specific remote device.

Transferring an RUI to another device as described herein enables the ability to separate and present some or all of a serving device's user interface on a remote device; allows a user to select which user interface components are able to be presented remotely and on which remote devices; and allows a user to interact with the serving device through the remote user interface. Transferring an RUI to another device implements an architecture and application framework that enables developers to organize an application's user interface elements into separate composition layers that encapsulate user interface presentation and interaction. Each layer is able to be distributed across multiple devices and the user interaction communicated back to the serving device's application. The distributed user interface is able to be executed on any networked device running the application framework.

Example 1

A user transfers TV XrossMediaBar (XMB™) and channel preview to a handheld device. The user is able to surf channels without affecting the television viewing.

Example 2

A handheld device is able to stream video content from a home media server. The handheld device then transfers the video stream to the television while retaining the playback control on the handheld device.

Figure 1:
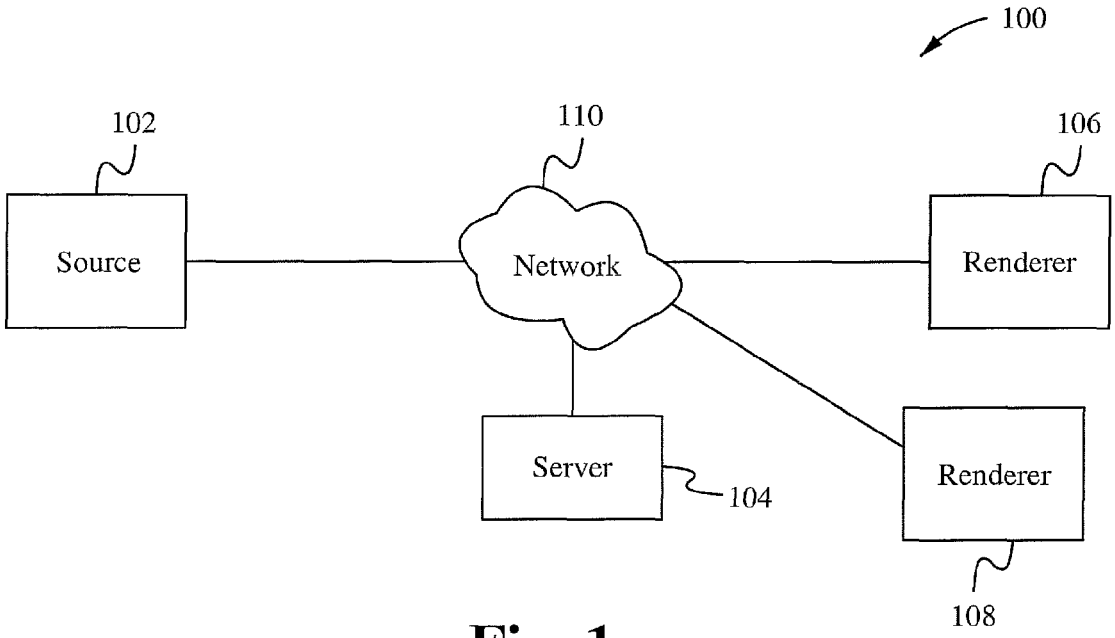
FIG. 1 illustrates a block diagram of a network of devices implementing a method of transferring an RUI from one device to another device according to some embodiments.

FIG. 1 illustrates a block diagram of a network of devices implementing a method of transferring an RUI from one device to another device according to some embodiments. The network of devices 100 includes one or more gateway or source devices 102 coupled to a server device 104 and one or more renderers (e.g. a television) 106 and 108. In some embodiments, the source device 102, the server device 104 and the renderers 106 and 108 are coupled directly, and in some embodiments, the source device 102, the server device 104 and the renderers 106 and 108 are coupled through a network 110. The network 110 is able to be any type of network including, but not limited to, a LAN, a WAN, the Internet, a cellular network, a wireless network, a wired network and/or any combination thereof.

The source device 102 is any device that sends RUI data such as RUI commands to a renderer 106. In some embodiments, the RUI data is sent to a server device 104 which processes the RUI data and then sends the processed data to the renderer 106. In some embodiments, the source device 102 also receives processed RUI data from the server device 104.

The server device 104 is any device that is able to separate and serve an RUI to the renderers 106 and 108. The server device 104 is also able to present an interface for a user to select which RUI components are presented remotely and on which remote devices. In some embodiments, the interface of the server device 104 is also an RUI. To allow separate aspects of an RUI to be presented on varying devices, the RUI is organized in separate composition layers that encapsulate RUI presentation and interaction. Each layer is able to be distributed across multiple devices, and the user interaction is communicated back to the server device 104. The server device also maintains state information of the RUI to enable easy transfer of the RUI to another device.

The renderer 106 is any device that is able to render and display the RUI data, for example, a television displaying an RUI.

For example, in operation, a user uses a mobile phone to send an RUI to a television. Then, the user chooses to switch the RUI to his mobile phone instead of the television. The user interface is then displayed on the mobile phone in the same state that was on the television (in the appropriate format for the mobile phone). Without the user's knowledge, the server maintains the state of the RUI so that it is easily transferred to the mobile phone without much, if any, delay.

In another example, a user displays a video on a television and displays an RUI on a mobile device, so that the RUI does not interfere with the video displayed on the television.

In another example, a user chooses to display an RUI and a video on both a mobile device and a television.

In some embodiments, the source device 102 and the renderer 106 are able to be the same device. For example, a user initially sends an RUI command with his mobile phone and then receives the RUI or at least an aspect of the RUI on the mobile phone.

Figure 2:
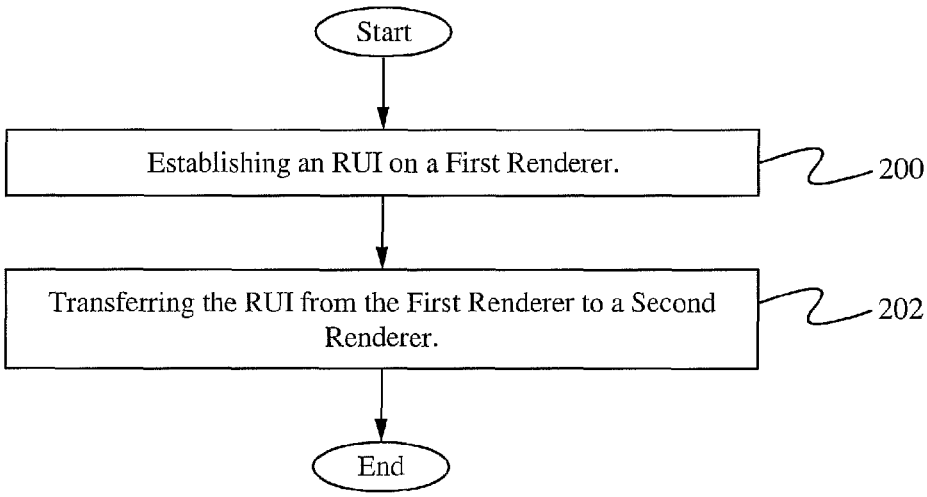
FIG. 2 illustrates a flowchart of a method of utilizing a network of devices according to some embodiments.

FIG. 2 illustrates a flowchart of a method of utilizing a network of devices according to some embodiments. In the step 200, an RUI is established/rendered on a first renderer such as a television. In some embodiments, the RUI is established after a source device sends an RUI command. The state of the RUI is monitored by a server. In the step 202, the RUI is transferred from the first renderer to a second renderer. The transfer occurs using the server to send the RUI to the second renderer including the state of the RUI. Additionally, the RUI is able to be separated and presented using the separate layers, for example, one aspect of the RUI is sent to a first device and a second aspect of the RUI is sent to a second device. In some embodiments, in addition to the RUI being transferred from one device to another, a video stream and/or other data is transferred. Although specific steps are described, in some embodiments, fewer or more steps are included, and/or the order of the steps is able to be changed. An additional possible step includes discovery of the server device by the source device and the rendering device.

Figure 3:
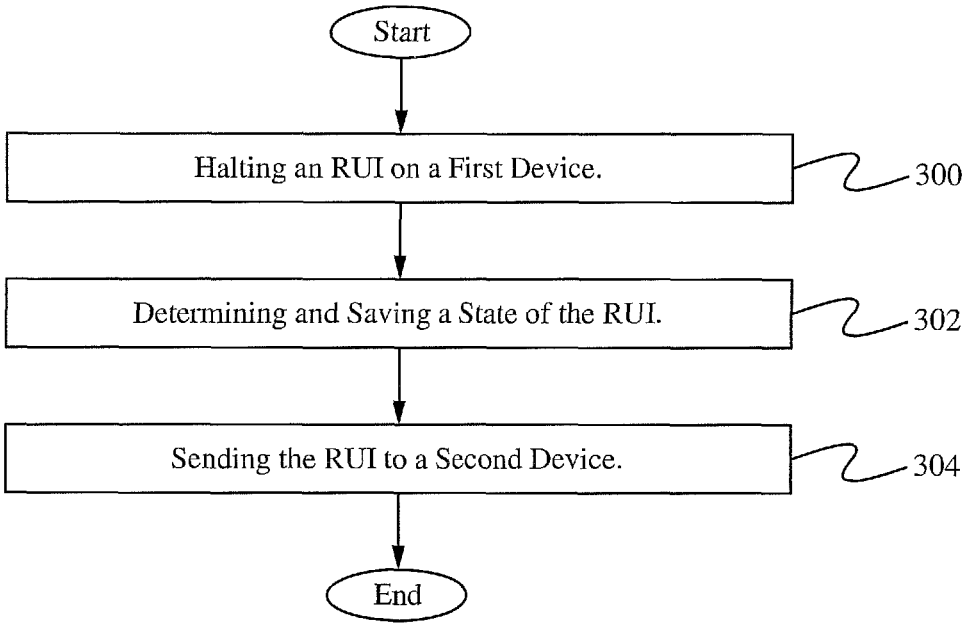
FIG. 3 illustrates a flowchart of a method of transferring an RUI from a first device to a second device according to some embodiments.

FIG. 3 illustrates a flowchart of a method of transferring an RUI from a first device to a second device according to some embodiments. In the step 300, the RUI is halted on the first device. The halting is able to be initiated by a user or by an automatic method such as based on a timer. Halting includes pausing or stopping the state of the RUI and/or media such as a video. For example, when a user transfers the RUI and video from a television to a mobile device, the RUI and video are stopped on the television. In some embodiments, the RUI is not halted and the step 300 is skipped. In the step 302, the state of the RUI is determined and saved using a server device. In some embodiments, determining and saving the state are the same step, and in some embodiments, they are separate steps. In some embodiments, the server continuously monitors the state of the RUI, and in some embodiments, a trigger causes the state to be determined (e.g. when the RUI is halted on the first device). In the step 304, the RUI is sent to a second device including the state information so that the RUI is displayed in the same state as it was on the first device. In some embodiments, the RUI is sent from the server device which contains a copy of the RUI. In some embodiments, the RUI is retrieved from the first device and is then sent to the second device. The RUI is then displayed on the second device. In some embodiments, in addition to the RUI being transferred to a second device, a video, music and/or other information is also transferred. Although specific steps are described, in some embodiments, fewer or more steps are included, and/or the order of the steps is able to be changed.

Figure 4:
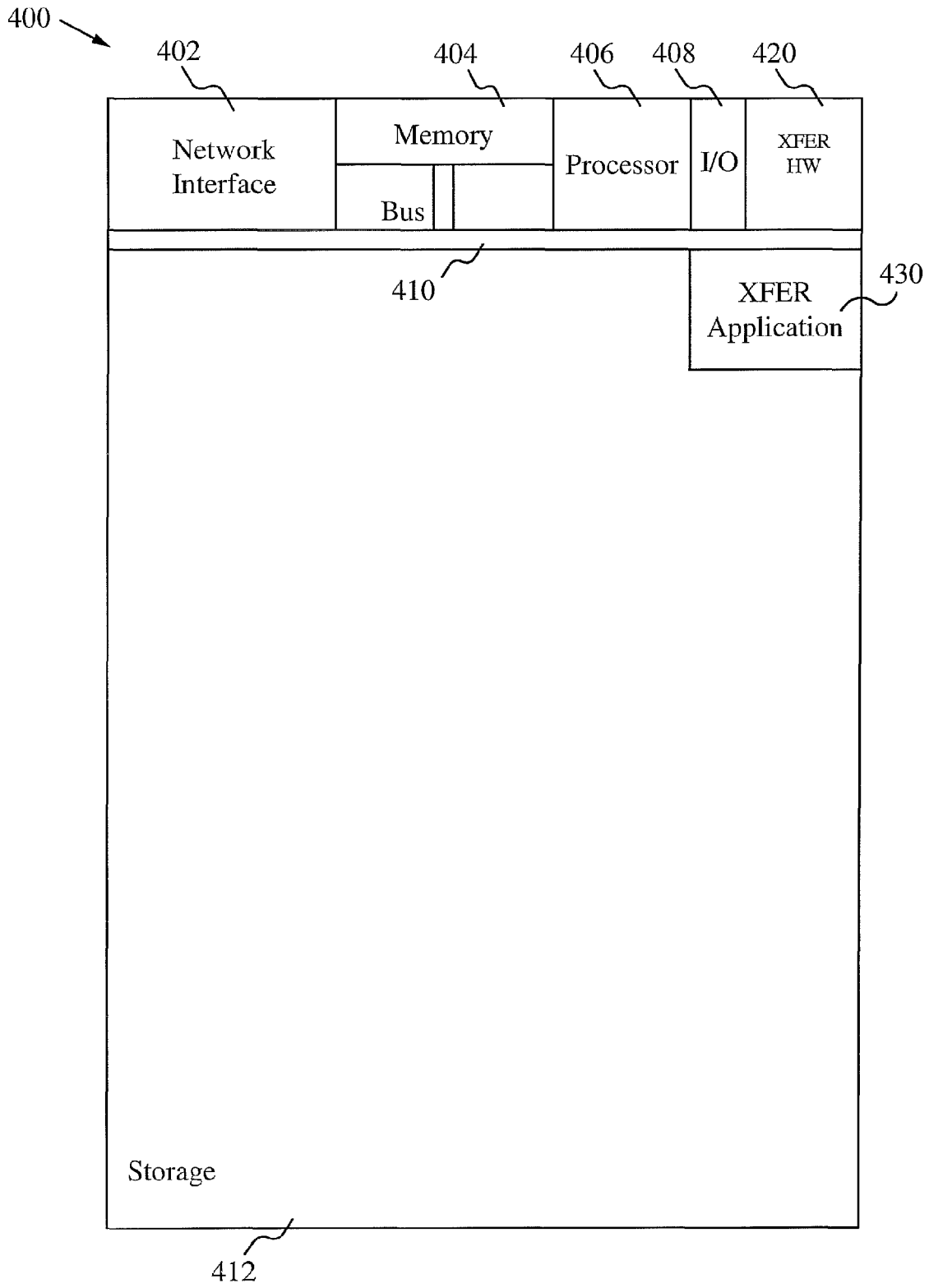
FIG. 4 illustrates a block diagram of an exemplary computing device according to some embodiments.

FIG. 4 illustrates a block diagram of an exemplary computing device 400 according to some embodiments. The computing device 400 is able to be used to acquire, store, compute, communicate, transfer and/or display information. For example, the computing device 400 is able to store an RUI state and transfer the RUI from one device to another device utilizing the RUI state. In general, a hardware structure suitable for implementing the computing device 400 includes a network interface 402, a memory 404, a processor 406, I/O device(s) 408, a bus 410 and a storage device 412. The choice of processor is not critical as long as a suitable processor with sufficient speed is chosen. The memory 404 is able to be any conventional computer memory known in the art. The storage device 412 is able to include a hard drive, CDROM, CDRW, DVD, DVDRW, Blu-ray®, flash memory card or any other storage device. The computing device 400 is able to include one or more network interfaces 402. An example of a network interface includes a network card connected to an Ethernet or other type of LAN. The I/O device(s) 408 are able to include one or more of the following: keyboard, mouse, monitor, display, printer, modem, touchscreen, button interface and other devices. Transfer application(s) 430 used to perform the transfer operations are likely to be stored in the storage device 412 and memory 404 and processed as applications are typically processed. More or less components shown in FIG. 4 are able to be included in the computing device 400. In some embodiments, transfer hardware 420 is included. Although the computing device 400 in FIG. 4 includes applications 430 and hardware 420, the transfer operations are able to be implemented on a computing device in hardware, firmware, software or any combination thereof. For example, in some embodiments, the transfer applications 430 are programmed in a memory and executed using a processor. In another example, in some embodiments, the transfer hardware 420 is programmed hardware logic including gates specifically designed to implement the remote user interface adapter operations.

In some embodiments, the transfer application(s) 430 include several applications and/or modules. As described herein, a state monitoring module monitors a state of an RUI and enables the transfer of the state from one device to another. A transfer module in conjunction with the state module transfers an RUI and/or media from one device to another device. A storage module stores the remote user interface state information. A halting module is for halting the remote user interface on the first device. In some embodiments, modules include one or more sub-modules as well. In some embodiments, fewer or additional modules are able to be included.

Examples of suitable computing devices include a personal computer, a laptop computer, a computer workstation, a server, a mainframe computer, a handheld computer, a personal digital assistant, a cellular/mobile telephone, a smart appliance, a gaming console, a digital camera, a digital camcorder, a camera phone, an iPod®/iPhone, a video player, a DVD writer/player, a Blu-ray® writer/player, a television, a home entertainment system or any other suitable computing device. In some embodiments, a computing device is able to include intelligent appliances such as a refrigerator, a toaster, a toaster oven and a microwave, where the appliances are able to process and/or present information.

To utilize the transfer method, a user uses a mobile device, for example, to control a television in playing a video in addition to an RUI. When the user chooses to play the video and/or the RUI on a second device, the user is able to switch the RUI and/or video to the second device, for example, by sending a switch device command. The server device assists in the switch so that the transfer between the devices is as seamless as possible. The user is also able to separate RUI aspects/components and/or videos on separate devices. For example, the user is able to watch a video on a television and display a channel display program on a handheld device.

In operation, the transfer of an RUI from one device to another device enables a user to seamlessly and easily transfer the RUI between devices. The transfer of the RUI is able to occur quickly and in the same state it was in at the previous device. Additionally, components of an RUI and/or a video are able to be separated and displayed on separate devices.

The devices implemented within the network described herein are able to implement Digital Living Network Alliance (DLNA) standard as well.

Although a RUI is described herein as being transferred from one device to another device, the RUI and/or media are able to be transferred from one or more devices to one or more devices. For example, an RUI and a video are transferred from a user's mobile device to three friend's mobile devices.

Some Embodiments of Transferring Rui from One Device to Another

1. A method of transferring a remote user interface from a first device to a second device comprising:
   a. determining a remote user interface state information;
   b. storing the remote user interface state information; and
   c. transferring the remote user interface to the second device including the remote user interface state information.
2. The method of clause 1 further comprising halting the remote user interface on the first device.
3. The method of clause 1 further comprising displaying the remote user interface on the second device.
4. The method of clause 1 wherein transferring includes transferring media from the first device to the second device.
5. The method of clause 1 wherein the remote user interface is transferred but a media remains on the first device.
6. The method of clause 5 wherein the media is at least one of an audio and a video.
7. The method of clause 1 wherein the remote user interface state information is stored on a server device.
8. The method of clause 7 wherein the server device, the first device and the second deivce are selected from the group consisting of a personal computer, a laptop computer, a computer workstation, a server, a mainframe computer, a handheld computer, a personal digital assistant, a cellular/mobile telephone, a smart appliance, a gaming console, a digital camera, a digital camcorder, a camera phone, an iPhone, an iPod®, a video player, a DVD writer/player, a television, a home entertainment system and an intelligent appliance.
9. A network of devices comprising:
   a. a first user device for displaying a remote user interface;
   b. a second user device for displaying the remote user interface; and
   c. a server device for transferring the remote user interface from the first user device to the second user device.
10. The network of devices of clause 9 wherein the server device stores a state of the remote user interface.
11. The network of devices of clause 9 wherein the remote user interface is halted on the first device.
12. The network of devices of clause 9 wherein transferring includes transferring media from the first device to the second device.
13. The network of devices of clause 9 wherein the remote user interface is transferred but a media remains on the first device.
14. The network of devices of clause 13 wherein the media is at least one of an audio and a video.
15. A system programmed in a controller in a device comprising:
   a. a state monitoring module for monitoring a state of a remote user interface on a first device; and
   b. a transferring module for transferring the remote user interface to a second device.
16. The system of clause 15 further comprising a halting module for halting the remote user interface on the first device.
17. The system of clause 15 wherein the transferring module is for transferring media to the second device.
18. The system of clause 15 wherein the transferring module is for transferring the remote user interface but a media remains on the first device.
19. The system of clause 18 wherein the media is at least one of an audio and a video.
20. The system of clause 15 further comprising a storage module for storing the remote user interface state information.
21. A server device comprising:
   a. a memory for storing an application, the application for:
      i. determining a remote user interface state information of a remote user interface;
      ii. storing the remote user interface state information; and
      iii. transferring the remote user interface to a receiving device including the remote user interface state information; and
   b. a processing component coupled to the memory, the processing component for processing the application.
22. The server device of clause 21 wherein the application is further for halting the remote user interface on a first device.
23. The server device of clause 21 wherein transferring includes transferring media from a first device to the receiving device.
24. The server device of clause 21 wherein the remote user interface is transferred but a media remains on a first device.
25. The server device of clause 24 wherein the media is at least one of an audio and a video.
26. The server device of clause 21 wherein the remote user interface state information is stored in the memory.

The present invention has been described in terms of specific embodiments incorporating details to facilitate the understanding of principles of construction and operation of the invention. Such reference herein to specific embodiments and details thereof is not intended to limit the scope of the claims appended hereto. It will be readily apparent to one skilled in the art that other various modifications may be made in the embodiment chosen for illustration without departing from the spirit and scope of the invention as defined by the claims.

What is claimed is:

1. A method of transferring a remote user interface from a first device to a second device comprising:

a. determining a remote user interface state information;

b. storing the remote user interface state information;

c. separating the remote user interface into a first component and a second component; and d. transferring the first component of the remote user interface to the second device including the remote user interface state information.

2. The method of claim 1 further comprising halting a state of the remote user interface on the first device.

3. The method of claim 1 further comprising displaying the remote user interface on the second device.

4. The method of claim 1 wherein transferring includes transferring media from the first device to the second device.

5. The method of claim 1 wherein the remote user interface is transferred but a media remains on the first device.

6. The method of claim 5 wherein the media is at least one of an audio and a video.

7. The method of claim 1 wherein the remote user interface state information is stored on a server device.

8. The method of claim 7 wherein the server device, the first device and the second deivce are selected from the group consisting of a personal computer, a laptop computer, a computer workstation, a server, a mainframe computer, a handheld computer, a personal digital assistant, a cellular/mobile telephone, a smart appliance, a gaming console, a digital camera, a digital camcorder, a camera phone, an iPhone, an iPod®, a video player, a DVD writer/player, a television, a home entertainment system and an intelligent appliance.

9. A network of devices comprising:

a. a first user device for separating a remote user interface into a first component and a second component and displaying the first component of the remote user interface;

b. a second user device for displaying the second component of the remote user interface; and c. a server device for transferring the remote user interface from the first user device to the second user device.

10. The network of devices of claim 9 wherein the server device stores a state of the remote user interface.

11. The network of devices of claim 9 wherein a state of the remote user interface is halted on the first device.

12. The network of devices of claim 9 wherein transferring includes transferring media from the first device to the second device.

13. The network of devices of claim 9 wherein the remote user interface is transferred but a media remains on the first device.

14. The network of devices of claim 13 wherein the media is at least one of an audio and a video.

15. A device comprising:

a. a memory for storing an application, the application comprising:

i. a state monitoring module for monitoring a state of a remote user interface on a first device;

ii. a separating module for separating the remote user interface into a first component and a second component; and iii. a transferring module for transferring the first component of the remote user interface to a second device; and b. a processor for processing the application.

16. The device of claim 15 further comprising a halting module for halting a state of the remote user interface on the first device.

17. The device of claim 15 wherein the transferring module is for transferring media to the second device.

18. The device of claim 15 wherein the transferring module is for transferring the remote user interface but a media remains on the first device.

19. The device of claim 18 wherein the media is at least one of an audio and a video.

20. The device of claim 15 further comprising a storage module for storing the remote user interface state information.

21. A server device comprising:

a. a memory for storing an application, the application for:

i. determining a remote user interface state information of a remote user interface;

ii. storing the remote user interface state information;

iii. separating the remote user interface into a first component and a second component; and iv. transferring the first component of the remote user interface to a receiving device including the remote user interface state information; and b. a processing component coupled to the memory, the processing component for processing the application.

22. The server device of claim 21 wherein the application is further for halting a state of the remote user interface on a first device.

23. The server device of claim 21 wherein transferring includes transferring media from a first device to the receiving device.

24. The server device of claim 21 wherein the remote user interface is transferred but a media remains on a first device.

25. The server device of claim 24 wherein the media is at least one of an audio and a video.

26. The server device of claim 21 wherein the remote user interface state information is stored in the memory.

* * * * *